US010308427B2

(12) United States Patent
Kreitzer, Sr.

(10) Patent No.: US 10,308,427 B2
(45) Date of Patent: Jun. 4, 2019

(54) LID SYSTEM FOR A FRONT LOAD DUMPSTER

(71) Applicant: Joseph Daniel Kreitzer, Sr., Knoxville, TN (US)

(72) Inventor: Joseph Daniel Kreitzer, Sr., Knoxville, TN (US)

(73) Assignee: Binova LLC, Knoxville, TN (US)

( * ) Notice: Subject to any disclaimer, the term of this patent is extended or adjusted under 35 U.S.C. 154(b) by 0 days.

(21) Appl. No.: 15/798,948

(22) Filed: Oct. 31, 2017

(65) Prior Publication Data

US 2018/0118460 A1 May 3, 2018

Related U.S. Application Data

(60) Provisional application No. 62/415,569, filed on Nov. 1, 2016.

(51) Int. Cl.
*B65D 45/00* (2006.01)
*B65F 1/16* (2006.01)
*B65F 1/12* (2006.01)

(52) U.S. Cl.
CPC ..... *B65F 1/1623* (2013.01); *B65F 1/1615* (2013.01); *B65F 1/122* (2013.01); *B65F 2001/1669* (2013.01)

(58) Field of Classification Search
CPC ..... B65F 1/22; B65F 1/1623; B65F 1/1615; B65F 2001/1669; B65F 1/122; B65F 1/16; B65F 1/1646; B65F 1/1452; B65F 1/1468; B65F 1/1473; B65F 3/26; B65F 3/24; Y10S 220/908
USPC ..... 220/252, 908, 260, 810, 811, 812, 817, 220/315, 263, 832; 292/230, 233; 294/68.1, 68.2, 68.26
See application file for complete search history.

(56) References Cited

U.S. PATENT DOCUMENTS 4,609,117 A 9/1986 Pamment
4,992,018 A 2/1991 Prout et al.
5,105,967 A 4/1992 Horpestad
5,118,000 A * 6/1992 Howell ..... B65F 1/122 220/315
5,360,132 A * 11/1994 Edelhoff ..... B65F 1/1607 220/213
6,296,132 B1 10/2001 Pickler
(Continued)

OTHER PUBLICATIONS

International Search Report in Written Opinion; PCT/US17/59233; dated Dec. 28, 2017.

*Primary Examiner* — Fenn C Mathew
*Assistant Examiner* — Elizabeth J Volz
(74) *Attorney, Agent, or Firm* — Pitts & Lake, P.C.

(57) ABSTRACT

A lid system for a front load dumpster is provided. The lid system provides a container assembly, an upper frame assembly having a curved lid, and a lower frame assembly, wherein the container assembly may rotate relative to the lower frame assembly and the upper frame assembly in a forward direction and an opposing rearward direction, while the upper frame assembly may rotate relative to the lower frame assembly only in the rearward direction so that the curved lid opens during dumping when the container assembly is in an upended condition, but the upper frame assembly and its curved lid may remain locked in a closed configuration when the container assembly is in an upright condition, before and after the dumping.

16 Claims, 4 Drawing Sheets

(56) References Cited

U.S. PATENT DOCUMENTS

| | | | | |
|---|---|---|---|---|
| 8,371,557 | B1 | 2/2013 | Buck | |
| 2002/0017529 | A1 | 2/2002 | Kruzick et al. | |
| 2002/0053570 | A1 | 5/2002 | Marcheselli et al. | |
| 2003/0168466 | A1* | 9/2003 | Spiers | B65F 1/1615 220/835 |
| 2005/0023839 | A1 | 2/2005 | Franich | |
| 2008/0017645 | A1 | 1/2008 | Garagiola | |

* cited by examiner

LID SYSTEM FOR A FRONT LOAD DUMPSTER

CROSS-REFERENCE TO RELATED APPLICATION

This application claims the benefit of priority of U.S. provisional application No. 62/415,569, filed 1 Nov. 2016, the contents of which are herein incorporated by reference.

BACKGROUND OF THE INVENTION

The present invention relates to container lids and, more particularly, to a lid system for a front load dumpster.

Current lid systems of front load dumpsters have shortcomings such as problems keeping the dumpster lids out of the truck hopper, maintaining dry loads, and solving lid lock issues. As a result, such lids are being torn from the containers, and the lids are not keeping rain water out. The front load system has needed updated for many years, the industry, however, has concluded there is no real solutions. Therefore, there are no current solutions for keeping the lids out of the front load dumpster truck, none for water in the dumpster and none for dry loads.

As can be seen, there is a need for a lid system for a front load dumpster incorporating three assemblies rotating independently, wherein the container assembly rotates independently relative to upper and lower lid assemblies in two directions.

The solutions are to both an end user and for the trash collector. The hauler would save money by not paying for water weight at the landfill (dry loads). Also, the hauler would save money by not replacing lids damaged by entering the truck hopper. The hopper has unpacked trash and a packing ram, this is where the lids are torn off or damaged. Dumpsters in many cases have a lid lock system that has a mechanism and a pipe over the lids, an addon part requested by their customer. During dumping the locking pipe over the lids are in the path of falling material causing damage to the lock bar system and mechanism. The present invention offers a lid lock system without a mechanism or a pipe over the lids, another cost saving feature. The present invention provides a lock system without the need for a pipe or bar over the lids and mechanism, and no need to purchase a lock bar system for one's dumpster.

SUMMARY OF THE INVENTION

In one aspect of the present invention, a lid container assembly for a front load dumpster includes a container assembly having two opposing sidewalls partially defining an opening to the container assembly; lifting elements provided by the container assembly for enabling the container assembly to pivotally rotate between an upended condition and an upright condition; a lid assembly rotatably mounted to the two opposing sidewalls so that the lid assembly is rotatable between an open configuration and a closed configuration closing off access to the opening; and a stopping mechanism operatively associated with each sidewall so that the lid assembly is prevented from rotating from the closed configuration while the container assembly is in the upright condition, while enabling the container assembly to rotate relative to the lid assembly in the upended condition.

In another aspect of the present invention, a lid container assembly for a front load dumpster includes a container assembly having two opposing sidewalls partially defining an opening to the container assembly; a lower frame assembly rotatably mounted to the two opposing sidewalls so that the container assembly is bi-directionally rotatable relative to the lower frame assembly between an upended condition and an upright condition; a stopping mechanism provided by the lower frame assembly; a lid assembly rotatably mounted to the two opposing sidewalls so that in the upended condition the lid assembly is bi-directionally rotatable relative to the container assembly between an open configuration and a closed configuration closing off access to the opening; and the stopping mechanism operatively associable with the lid assembly so that the lid assembly is uni-directionally rotatable in the upright condition.

In yet another aspect of the present invention, a lid container assembly for a front load dumpster includes a container assembly having opening; a lower frame assembly rotatably mounted to the container assembly so that the container assembly is bi-directionally rotatable relative to the lower frame assembly between an upended condition and an upright condition; a stopping mechanism provided by the lower frame assembly; a lid assembly rotatably mounted to the container assembly so that in the upended condition the lid assembly is bi-directionally rotatable relative to the container assembly between an open configuration and a closed configuration closing off access to the opening; and the stopping mechanism operatively associable with the lid assembly so that the lid assembly is prevented from rotating in the direction the container assembly is rotating relative to the lower frame assembly.

These and other features, aspects and advantages of the present invention will become better understood with reference to the following drawings, description and claims.

DETAILED DESCRIPTION OF THE INVENTION

Figure 1:
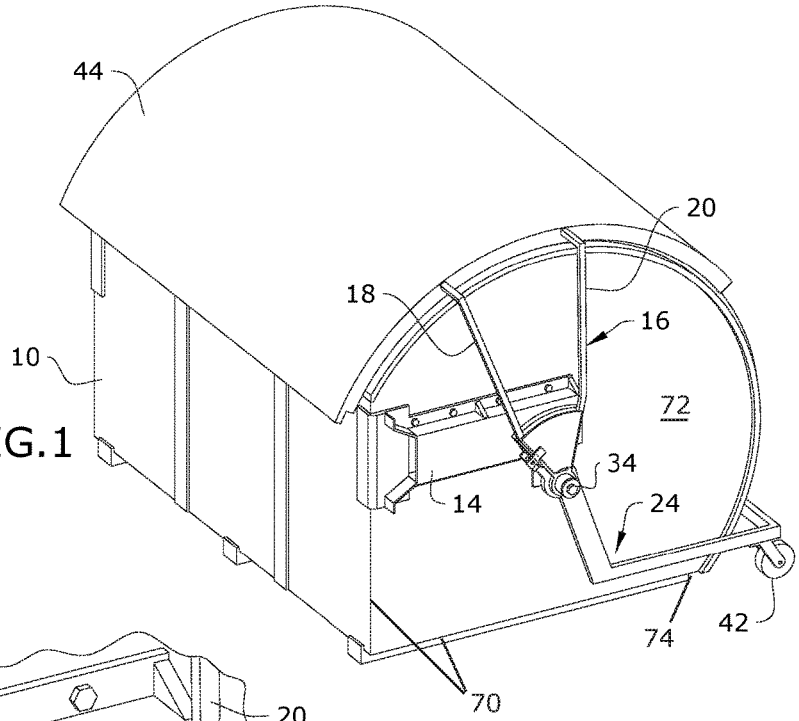
FIG. 1 is a perspective view of an exemplary embodiment of the present invention, illustrating a closed configuration.
Figure 2:
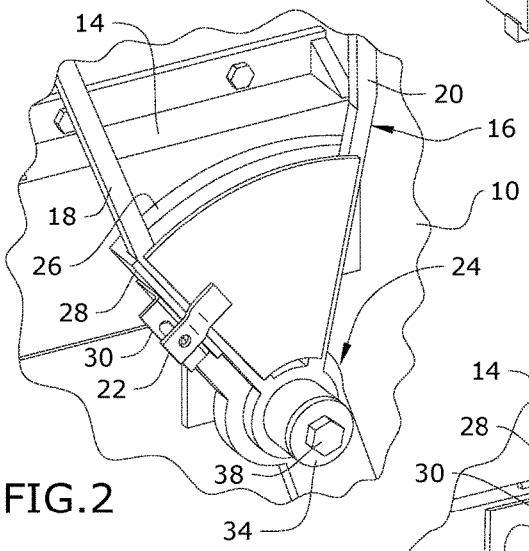
FIG. 2 is a detail perspective view of an exemplary embodiment of the present invention.
Figure 3:
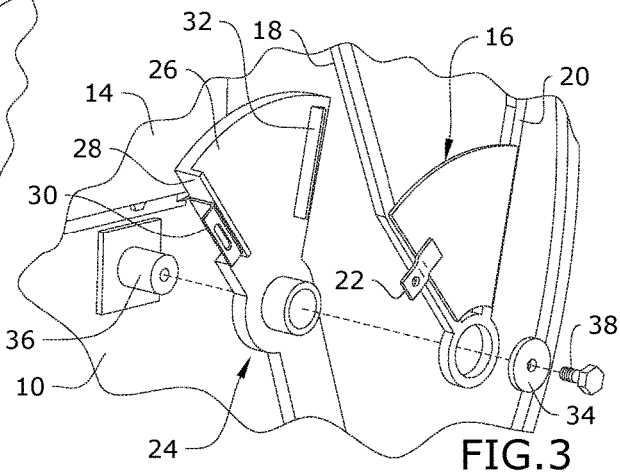
FIG. 3 is a detailed exploded view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a container assembly, an upper frame assembly having a curved lid, and a lower frame assembly, wherein the container assembly may rotate relative to the lower frame assembly and the upper frame assembly in a forward direction and an opposing rearward direction, while the upper frame assembly may rotate relative to the lower frame assembly only in the rearward direction so that the curved lid opens during dumping when the container assembly is in an upended condition, but the upper frame assembly and its curved lid may remain locked in a closed configuration when the container assembly is in an upright condition, before and after the dumping. The upended condition could be understood to be when the bottom portion of the container assembly 10 is generally engaging the ground 46.

It should be understood by those skilled in the art that the use of directional terms such as front/forward and rearward are used in relation to the illustrative embodiments as they are depicted in the figures, the forward direction being toward the left of the corresponding figures and a rearward direction being toward the right of the corresponding figures, but that the terms 'rearward' and 'forward' are for ease of understanding for how the present invention operates relative to its three assembly components, not to limit the absolute direction in which these components can rotate.

Referring to FIGS. 1 through 10, the present invention may include a container assembly 10, an upper frame assembly 16 providing a curved lid 44, and a lower frame assembly 24, wherein the container assembly 10 may rotate relative to the lower frame assembly 24 and the upper frame assembly 16 in a forward direction 50 and an opposing rearward direction 60, while the upper frame assembly 16 may rotate relative to the lower frame assembly 24 only in the rearward direction 60, and only if not in a locked configuration.

Referring to FIG. 1, the container assembly 10 provides a block shaped body 70 with arced sidewalls 72. The arced sidewalls are partially defined by peripheral arc rails 12 that in essence connect opposing peripheral edges 74 of the blocked shaped body 70 so as to define an opening 80 to the inner housing of the container assembly 10.

The arced sidewalls 72 each provide a pivot protrusion 36 unto which the upper frame assembly 16 rotatably associates via an upper lock bracket 22. A forward arm 18 and rearward arm 20 may interconnect the upper lock bracket 22 and the curved lid 44 so that the curved lid 44 may circumferentially slide along the arc rails 12 relative to the opening 80 of the container assembly 10 between a closed configuration and an open configuration as the container assembly 10 or the upper frame assembly 16 rotates between the rearward direction 60 and the forward direction 50 respectively.

Figure 4:
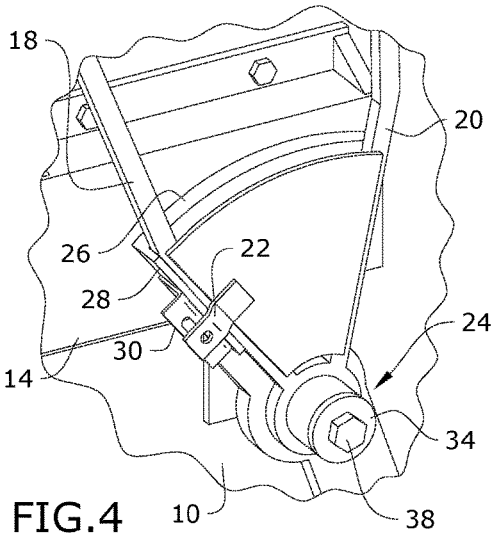
FIG. 4 is a detailed perspective view of an exemplary embodiment of the present invention, illustrating a locked configuration.
Figure 6:
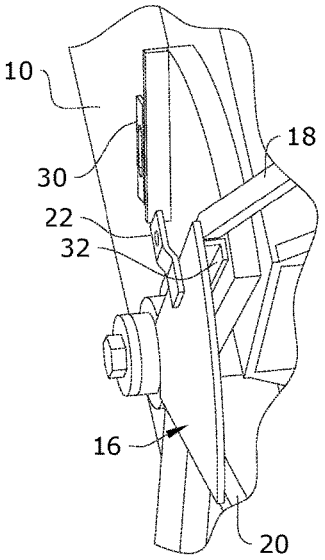
FIG. 6 is a detailed top perspective view of an exemplary embodiment of the present invention.
Figure 5:
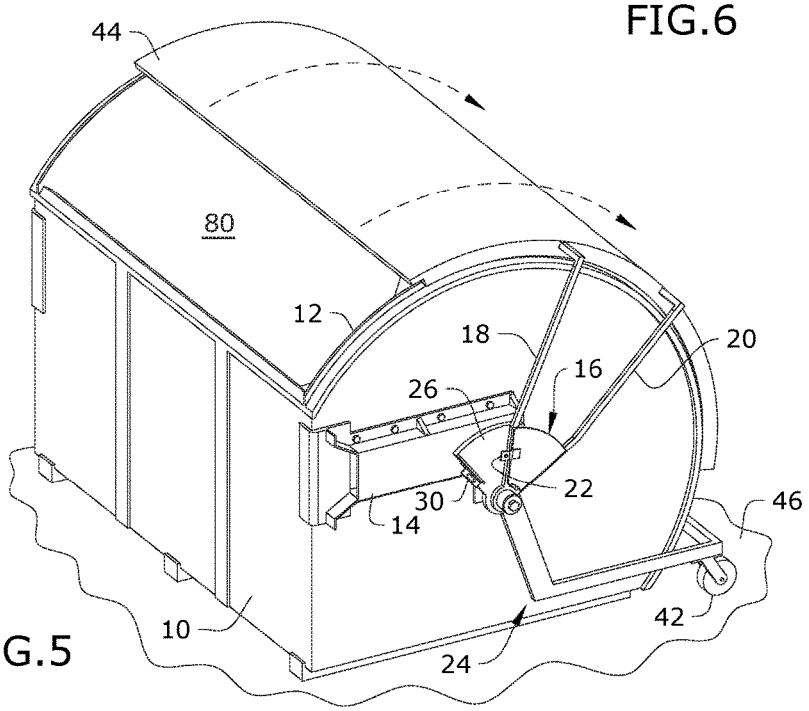
FIG. 5 is a perspective view of an exemplary embodiment of the present invention, illustrating an open configuration.

The lower frame assembly 24 provides a pair of spaced apart upward arms 25 terminating with frame plates 26. The upper arms 25/frame plates 26 operatively engage the pivot protrusion 36 of the container assembly 10 so that the container assembly 10 may rotate relative to the lower frame assembly 24 in a forward direction 50 and an opposing rearward direction 60. The frame plates 26 may provide a forward stopping mechanism 28 and lower lock bracket 30 on a forward-facing side, while providing a rear bracket 32 on the rearward side of the frame plate 26. The upper fame assembly 16 operatively associates with the forward stopping mechanism 28 to prevent the upper frame assembly 16 rotating relative to the lower frame assembly 24 in the forward direction 50. The upper lock bracket 22 operatively associates with the lower lock bracket 30 in a locked configuration, as illustrated in FIG. 4, so that a locking mechanism (not shown) may engage both (or holes of both) to lock the upper frame assembly 16 rotating relative to the lower frame assembly 24. However, the upper frame assembly 16 may rotate from the lower frame assembly 24, relatively, only in the rearward direction 60 when the container assembly 10 is in an upright condition, so that a user may move the curved lid 44 between the closed and open configuration for loading the housing with objects, such as trash. It being understood that the in such open configuration, a user may move the upper frame assembly 16 in the forward direction 50, generally speaking, to the closed configuration, but the upper frame assembly 16 does not move from the lower frame assembly 24 in the forward direction 50. When the upper and lower frame assemblies operative associate with the pivot protrusions 36, cover plates 34 and fasteners 38 may be used to secure such associate, while allowing the above-mentioned pivotal rotation.

Figure 7:
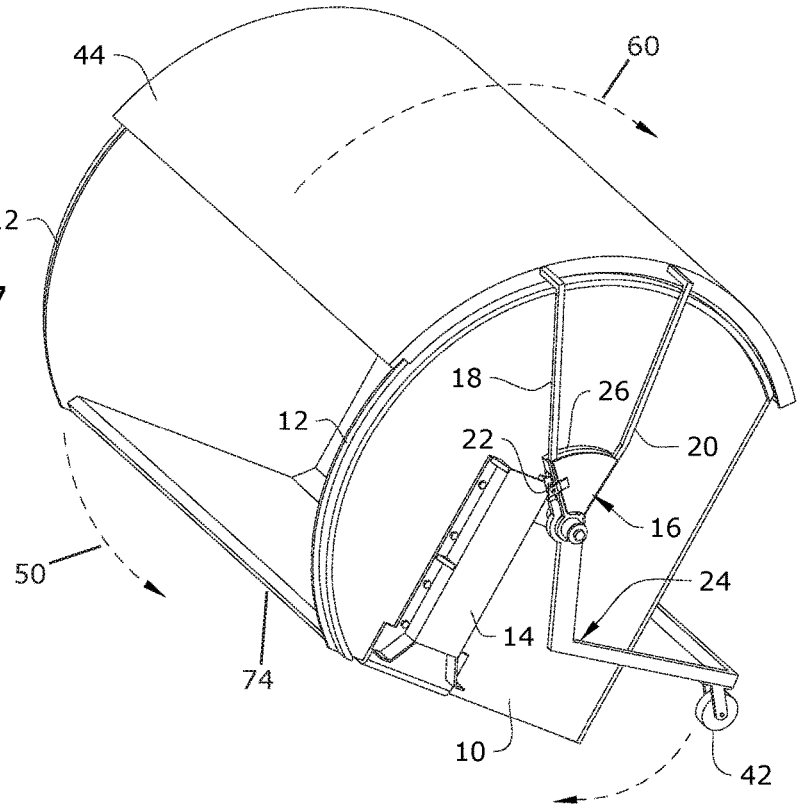
FIG. 7 is a perspective view of an exemplary embodiment of the present invention, demonstrating the process of the present invention being upended and opened.
Figure 8:
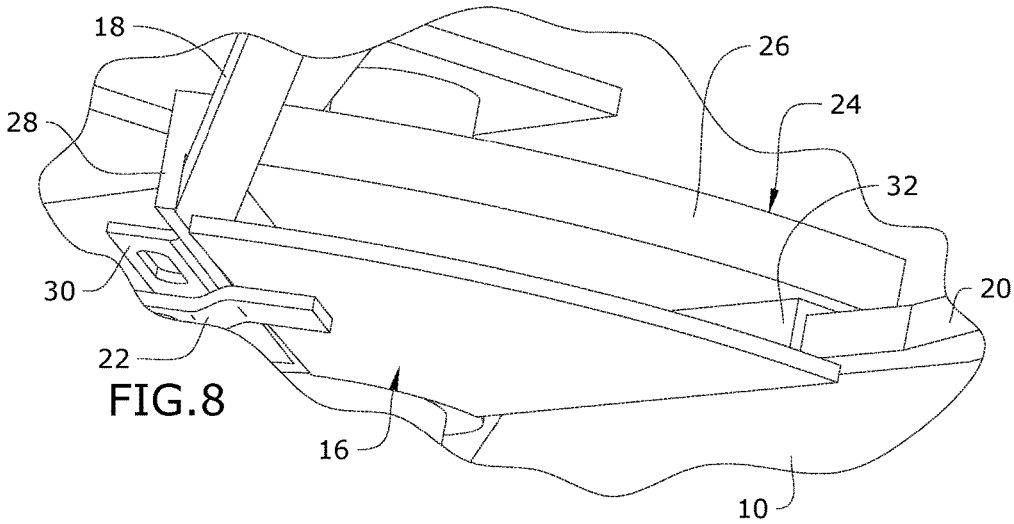
FIG. 8 is a detailed perspective view of an exemplary embodiment of the present invention, demonstrating the process of the present invention being upended and opened.
Figure 9:
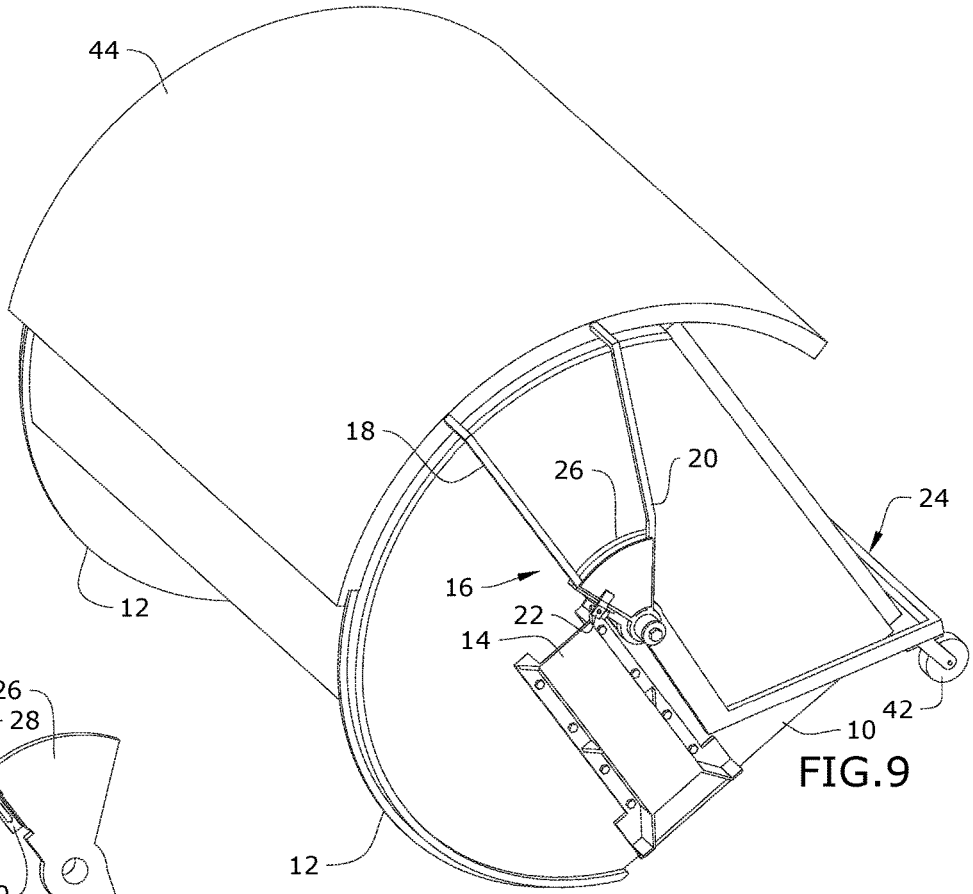
FIG. 9 is a perspective view of an exemplary embodiment of the present invention, illustrating an open configuration.
Figure 10:
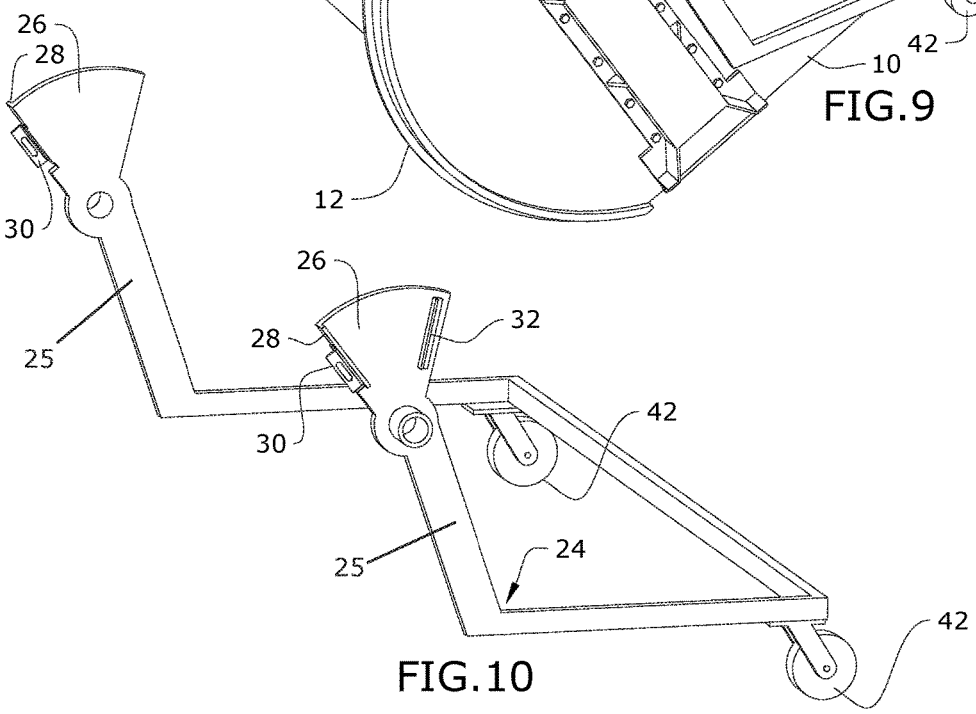
FIG. 10 is a perspective view of an exemplary embodiment of the present invention, illustrating a lower frame assembly.

The container assembly 10 further includes attachments, such as fork channels 14, for accommodating various forked lifting mechanisms of the trash removal vehicle. The container assembly 10 are lifted by the lifting mechanism of the trash removal vehicle and pivotally rotated in the forward direction 50 so that the container assembly 10 rotates relative the lower frame assembly 24, which in turn, prevents the upper frame assembly 16 from rotating in the forward direction 50, while the container assembly 10 rotates to an upended condition, as illustrated in FIG. 7. Thereby the container assembly 10 rotates relative to the curved lid 44 of the upper frame assembly 16, uncovering the opening 80 to the housing of the container assembly 10, whereby the container assembly 10 moves to the open configuration and the trash contained therein is emptied into the vehicle. The container assembly 10 is then returned to the upright condition on the ground 46, by pivotal rotation in the rearward direction 60, resulting in the closed condition, as illustrated in FIG. 1. The lower frame assembly 24 may provide wheels 42 to facilitate the pivotal rotation between the upright condition and the upended condition.

It being understood that in the closed configuration, the curved lid 44/upper frame assembly 16 may be locked from moving in the rearward direction 60, thereby preventing undesired open configurations when the container assembly 10 is in the upright condition, while still enabling use/open configuration by a trash removal vehicle via the upended condition.

It should be understood, of course, that the foregoing relates to exemplary embodiments of the invention and that modifications may be made without departing from the spirit and scope of the invention as set forth in the following claims.

What is claimed is:

1. A lid container assembly, comprising:

a container assembly having two opposing sidewalls partially defining an opening to the container assembly, wherein the container assembly is adapted to pivotally rotate between an upended condition and an upright condition;

a lid assembly rotatably mounted to the two opposing sidewalls so that the lid assembly is rotatable between an open configuration and a closed configuration closing off access to the opening;

a stopping mechanism operatively associated with each sidewall so that the lid assembly is prevented from rotating from the closed configuration while the container assembly is in the upright condition, while enabling the container assembly to rotate relative to the lid assembly in the upended condition;

a lower frame assembly providing the stopping mechanism, wherein the container assembly rotates relative to the lower frame assembly in the upended condition; and wheels provided along the lower frame assembly for facilitating the pivotal rotation to and from the upended condition.

2. The lid container assembly of claim 1, wherein each sidewall provides a peripheral arc rails further defining the opening.

3. The lid container assembly of claim 2, wherein the lid assembly operatively engages both opposing peripheral arc rails when rotating between the open and closed configurations.

4. The lid container assembly of claim 2, wherein the lid assembly provides a curved lid for engaging the container assembly between the open and closed configurations.

5. The lid container assembly of claim 4, wherein the curved lid is dimensioned for engaging both opposing peripheral arc rails.

6. The lid container assembly of claim 1, further comprising lifting elements provided by the container assembly for enabling the container assembly to pivotally rotate between the upended condition and the upright condition.

7. A lid container assembly, comprising:

a container assembly having two opposing sidewalls partially defining an opening to the container assembly;

a lower frame assembly rotatably mounted to the two opposing sidewalls so that the container assembly is bi-directionally rotatable relative to the lower frame assembly between an upended condition and an upright condition;

a stopping mechanism provided by the lower frame assembly;

a lid assembly rotatably mounted to the two opposing sidewalls so that in the upended condition the lid assembly is bi-directionally rotatable relative to the container assembly between an open configuration and a closed configuration closing off access to the opening;

the stopping mechanism operatively associable with the lid assembly so that the lid assembly is uni-directionally rotatable in the upright condition; and wheels provided along the lower frame assembly for facilitating the bi-directional rotational motion to and from the upended condition.

8. The lid container assembly of claim 7, further comprising lifting elements provided by the container assembly for facilitating the container assembly to bi-directionally rotate between the upended condition and the upright condition.

9. A lid container assembly, comprising:

a container assembly having two opposing sidewalls partially defining an opening to the container assembly;

a lower frame assembly rotatably mounted to the two opposing sidewalls so that the container assembly is bi-directionally rotatable relative to the lower frame assembly between an upended condition and an upright condition;

a stopping mechanism provided by the lower frame assembly;

a lid assembly rotatably mounted to the two opposing sidewalls so that in the upended condition the lid assembly is bi-directionally rotatable relative to the container assembly between an open configuration and a closed configuration closing off access to the opening;

the stopping mechanism operatively associable with the lid assembly so that the lid assembly is uni-directionally rotatable in the upright condition; and wherein each sidewall provides a peripheral arc rails further defining the opening.

10. The lid container assembly of claim 9, wherein the lid assembly operatively engages both opposing peripheral arc rails when rotating between the open and closed configurations.

11. The lid container assembly of claim 9, wherein the lid assembly provides a curved lid for engaging the container assembly between the open and closed configurations.

12. The lid container assembly of claim 11, wherein the curved lid is dimensioned for engaging both opposing peripheral arc rails.

13. A lid container assembly, comprising:

a container assembly having an opening;

a lower frame assembly rotatably mounted to the container assembly so that the container assembly is bi-directionally rotatable relative to the lower frame assembly between an upended condition and an upright condition;

a stopping mechanism provided by the lower frame assembly;

a lid assembly rotatably mounted to the container assembly so that in the upended condition the lid assembly is bi-directionally rotatable relative to the container assembly between an open configuration and a closed configuration closing off access to the opening; and the stopping mechanism operatively associable with the lid assembly so that the lid assembly is prevented from rotating in the direction the container assembly is rotating relative to the lower frame assembly, wherein the opening is partially defined by two spaced apart peripheral arc rails.

14. The lid container assembly of claim 13, wherein the lid assembly operatively engages the two spaced apart peripheral arc rails when rotating between the open and closed configurations.

15. The lid container assembly of claim 14, wherein the lid assembly provides a curved lid for engaging the container assembly between the open and closed configurations.

16. The lid container assembly of claim 15, wherein the curved lid is dimensioned for engaging the two spaced apart peripheral arc rails.

* * * * *